United States Patent [19]

Streetman et al.

[11] Patent Number: 4,573,396

[45] Date of Patent: Mar. 4, 1986

[54] NUCLEAR BLAST HARDENED MOBILE VEHICLE

[75] Inventors: Joe W. Streetman, San Diego; Anton K. Simson, Poway, both of Calif.

[73] Assignee: General Dynamics Corporation/Convair Div., San Diego, Calif.

[21] Appl. No.: 505,554

[22] Filed: Jun. 17, 1983

[51] Int. Cl.[4] ..... F41H 7/02

[52] U.S. Cl. ..... 89/36.08; 89/1.815; 180/209; 280/43.24; 250/515.1; 109/1 S

[58] Field of Search ..... 180/9.5, 209, 123, 116, 180/124, 125; 280/43.24; 250/515.1, 517.1, 519.1; 89/36 R, 36 H, 36 K, 40 B, 1 A, 1.8, 1.801, 1.815, 36 F; 105/394; 52/169.12; 109/1 R, 1 S, 49.5, 75; 405/188, 189

[56] References Cited

U.S. PATENT DOCUMENTS

| | | | |
|---|---|---|---|
| 3,702,597 | 11/1972 | Odum et al. | 405/188 |
| 3,810,522 | 5/1974 | Morgan et al. | 180/116 |
| 3,882,960 | 5/1975 | Wilson et al. | 180/124 |
| 4,020,607 | 5/1977 | Bjerrig | 49/477 |
| 4,047,390 | 9/1977 | Boyce, II | 405/188 |
| 4,107,888 | 8/1978 | Krueger | 52/169.12 |
| 4,122,909 | 10/1978 | Fair et al. | 180/116 |
| 4,237,992 | 12/1980 | Bristow | 180/116 |

FOREIGN PATENT DOCUMENTS

| | | | |
|---|---|---|---|
| 652025 | 10/1937 | Fed. Rep. of Germany | 89/36 |
| 826322 | 3/1938 | France | 89/36 K |
| 1037500 | 9/1953 | France | 89/36 H |
| 1329023 | 4/1963 | France | 89/36 H |
| 1339275 | 8/1963 | France | 180/124 |
| 2368007 | 10/1976 | France | 89/36 H |
| 26576 | of 1904 | United Kingdom | 405/188 |

OTHER PUBLICATIONS

Popular Mechanics, *Army Troop-Cargo Carrier Rolls on Rubber Pillows*, p. 70 (Aug. 1955).

Ordnance, *A New Army Vehicle*, p. 48 (Jul.-Aug. 1955).

*Primary Examiner*—Stephen C. Bentley

*Attorney, Agent, or Firm*—John R. Duncan; H. F. Mohrlock

[57] ABSTRACT

A mobile vehicle having a high degree of survivability against a nearby nuclear blast. The vehicle includes a chasis on which wheels or the like are mounted for movement along the earth's surface and a protective shell covering the vehicle. A skirt extends downwardly from the shell to a substantially uniform distance above the earth's surface during normal conditions. In the event of a nearby nuclear detonation, sensors on the top of the shell detect the initial flash and initiate braking, retraction of the wheels, and closure of any vents. The vehicle comes to rest on the skirts, which may include seals in contact with the earth. Blast overpressure and winds cannot leak underneath the vehicle. Overpressure on top then forces the vehicle tightly against the earth, preventing it from being overturned or blown away by the blast winds. Thereafter, the vehicle can return to its normal function, e.g. erect and launch a missile contained therein, extend the wheels and resume movement, etc.

11 Claims, 9 Drawing Figures

NUCLEAR BLAST HARDENED MOBILE VEHICLE

BACKGROUND OF THE INVENTION

This invention relates in general to mobile military vehicles, and, more specifically, to a vehicle which is highly resistant to the blast overpressure, wind and radiation affects of a nearby nuclear detonation.

In order to maintain a credible deterrent to nuclear attack, it is necessary that retaliatory forces survive a nuclear "first strike" with the capability of responding. A major problem is protecting intercontinental ballistic missile (ICBM's) and their associated control equipment against such a first strike. Fully hardened silos and the like for land-based ICBM's are generally effective, but only at great cost. Also, the degree of hardening, may become insufficient with improvements in accuracy and power of the "first-strike" weapons.

In order to limit the ability to accurately target retaliatory missiles, various mobile missile concepts have been proposed. Generally, the missile is moved among a number of fixed, hardened protection enclosures. Unfortunately, the number of enclosures is limited by their high cost, and it is becoming possible to simultaneously attack a large number of such enclosures using multiple independent reentry vehicles (MIRV).

Armored missile-carrying vehicles have been proposed which are either road mobile or helicopter carried. However, these have proved to be very large, heavy and cumbersome. Also, they tend to be easily overturned or blown away by the blast winds resulting from otherwise-survivable nuclear detonations in the vicinity.

The commonly proposed solution for the blast wind problem is to tie the vehicle down or to extend struts or outriggers. These are impractical because there is generally insufficient time to stop the vehicle and engage tie-downs or extend struts, the tie-down anchors must be already in place with the capability to withstand loads in the 100,000 pound range, and struts would be prohibitively long and heavy. Attempts have been made to seal structures to the ground and/or fasten them between spaced walls to help resist nearby nuclear blasts. These structures, while increasing blast resistance somewhat, have not been entirely satisfactorily mobile, could not reach the protected status quickly and resist blast waves only to a limited degree.

Thus, there is a continuing need for a hardened mobile vehicle for ICBM's or the like which can be easily moved on-or off-road and which can resist the effects of nearby nuclear detonations.

SUMMARY OF THE INVENTION

The above-noted problems, and others, are overcome by a nuclear blast hardened mobile vehicle capable of carrying an ICBM, a control center, etc., which includes a blast resistant protective shell over the contents and fastened to a chasis which is movable on a plurality of driven motive members such as wheels, tracks, or the like. Sensors on the shell detect the light flash of a nearby nuclear detonation and start an automatic sequence of braking, motive member retraction, vent closure and seal activation (if used). A skirt around the shell rides a uniform selected distance above the ground when the vehicle is in motion. When the motive members are retracted, the skirt drops into engagement with the earth to prevent blast over-pressure winds from leaking under the vehicle. The protective skirt also absorbs the thermal radiation, preventing destruction of the driven motive members, which may include rubber tires or the like. Once the blast over-pressure has passed the vehicle, an ICBM carried thereby can be erected and launched, any other facility carried by the vehicle can continue in operation, or the motive members can be extended and the vehicle can again move under its own power.

Sealing of the skirt against the earth's surface can be enhanced in any of several ways, if desired. The bottom edge of the skirt can be designed to maximize friction for a range of ground surfaces. Seals or short struts designed to accommodate an irregular ground surface may be used. The chamber bounded by the bottom of the vehicle, the ground surface under the vehicle and the skirts may be reduced to less than atmospheric pressure by actively pumping air from that chamber to increase the downward force and the resulting horizontal friction force resisting blow-away.

Chamber volume overpressure relief valves may be provided to relieve the pressure in the volume under the vehicle if it exceeds the lowest pressure outside the vehicle. This excess pressure may be due to chamber skirt seal leakage and/or outside pressure below normal due to blast rarefaction wave. The relief valves will be mounted so that the chamber is automatically vented to the lowest pressure face of the vehicle. If desired, the protective sequence may be initiated manually upon receipt of an attack warning instead of automatically by the sensors.

BRIEF DESCRIPTION OF THE DRAWING

Details of the invention, and of preferred embodiments thereof, will be further understood upon reference to the drawing wherein.

DETAILED DESCRIPTION OF THE INVENTION

Figure 1:
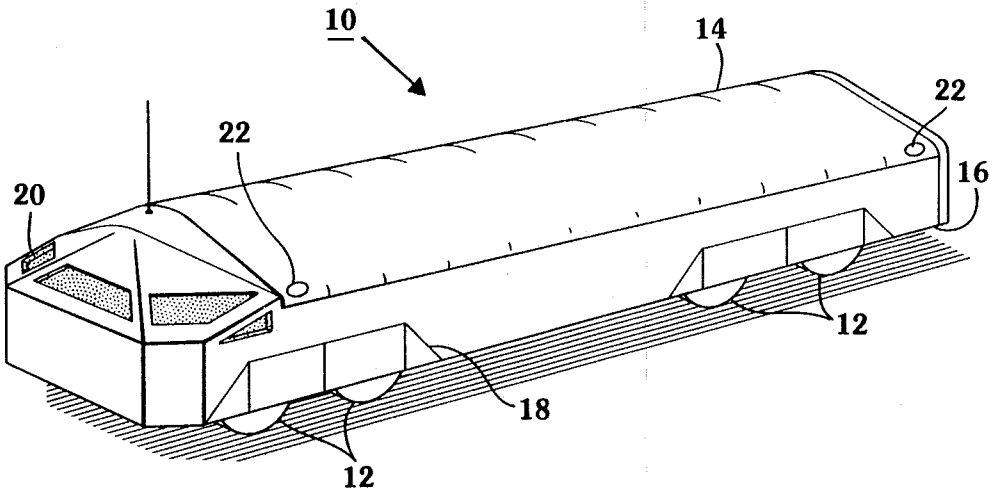
FIG. 1 is a perspective view of the vehicle of this invention during movement.

Referring now to FIG. 1, there is seen a low profile mobile vehicle 10 which rides on a plurality of wheels 12. A slightly domed shell 14 sourrounds the vehicle, terminating in a skirt 16, the lower edge of which rides at a substantially uniform distance from the ground. Skirt 16 includes suitable panels 18 for access to wheels 12. Windows 20 are provided for use by the driver. Vents (not shown) are provided in the front, back or underside of vehicle 10 for ingress and egress of air for passengers, engines, etc. A plurality of sensors 22 are provided on shell 14 to detect the flash of nearby nuclear detonations.

While wheels 12 are shown in this preferred embodiment as the motive members to move the vehicle over the earth's surface, any other suitable arrangement could be used if desired, such as tracks.

Shell 14 and skirt 16 may be formed from any suitable material. Preferably, the shell will be composed of a plurality of layers of different materials, which in combination provide an optimum structure in terms of resistance to intrusion, blast overpressure, projectiles, thermal radiation and nuclear radiation, all at the lowest possible weight. However, sufficient compressive strength is needed in the shell and its supporting structure to resist the considerable overpressure resulting from a nuclear blast. While steel or aluminum or other conventional structural materials may be used, composite materials using high strength fibers in a matrix such as boron/aluminum, graphite/epoxy, etc., are preferred for their high strength-to-weight ratios. Windows 20 and any vent covers must similarly be constructed to resist the blast overpressure.

Any suitable contents may be carried within vehicle 10. Typically, vehicle 10 may carry an ICBM together with missile erection and launch means, or a control center for launching such missiles. Other missiles, such as cruise missiles, anti-missile missiles or the like could also be carried.

Figure 2:
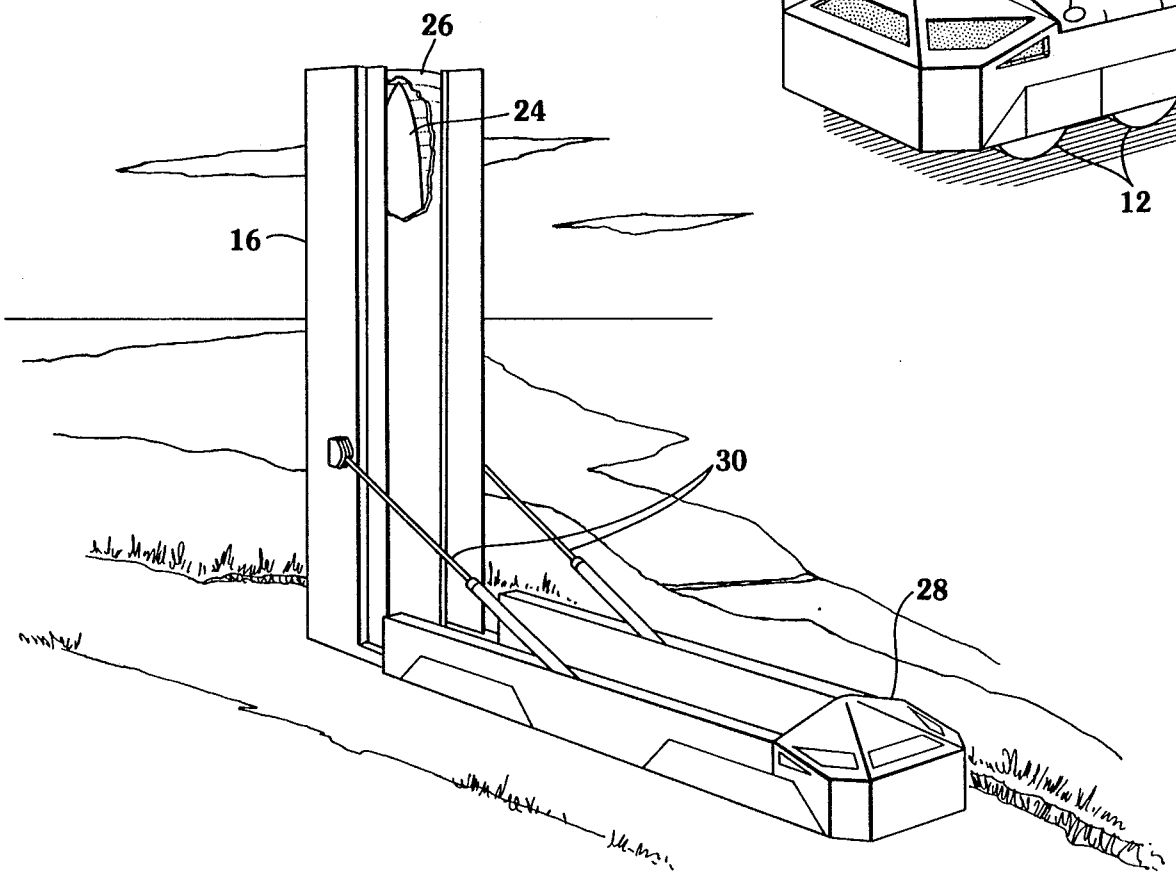
FIG. 2 is a perspective view of the vehicle in position for launching an ICBM.

FIG. 2 illustrates a preferred embodiment in which shell 14 opens to erect a missile 24 for launch. Missile 24 is housed in a canister 26 (partially cut away here for clarity) fastened to the uppermost portion of shell 14. The remainder of vehicle 10, including the front driver and control section 28 and skirt 16 section remain in the original configuration. While the wheels 12 could remain extended, it is generally preferred that they be retracted as detailed below, with vehicle 10 resting on the ground on the lower edges of skirt 16. The upper portion of shell 16 is erected by a conventional hydraulic system (not shown) acting through actuator arms 30. In the case of a retaliatory launch, vehicle will remain on the ground with wheels retracted until any incoming attack is over, then the missile is raised to launch position and is launched.

Figure 3:
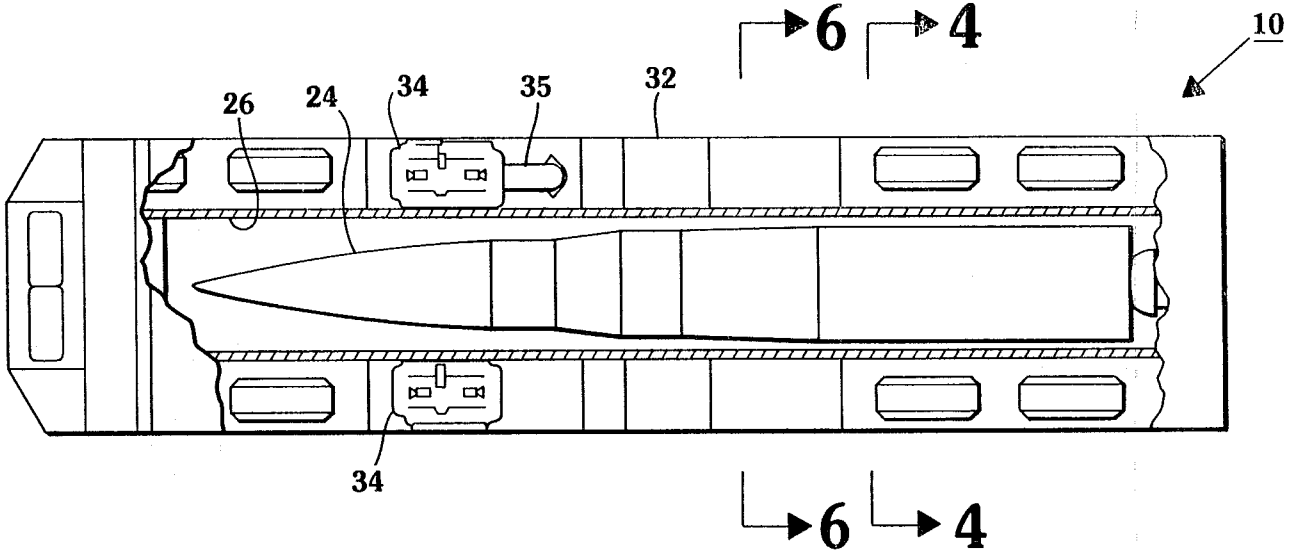
FIG. 3 is a schematic elevation view, partially cutaway, of the vehicle.
Figure 4:
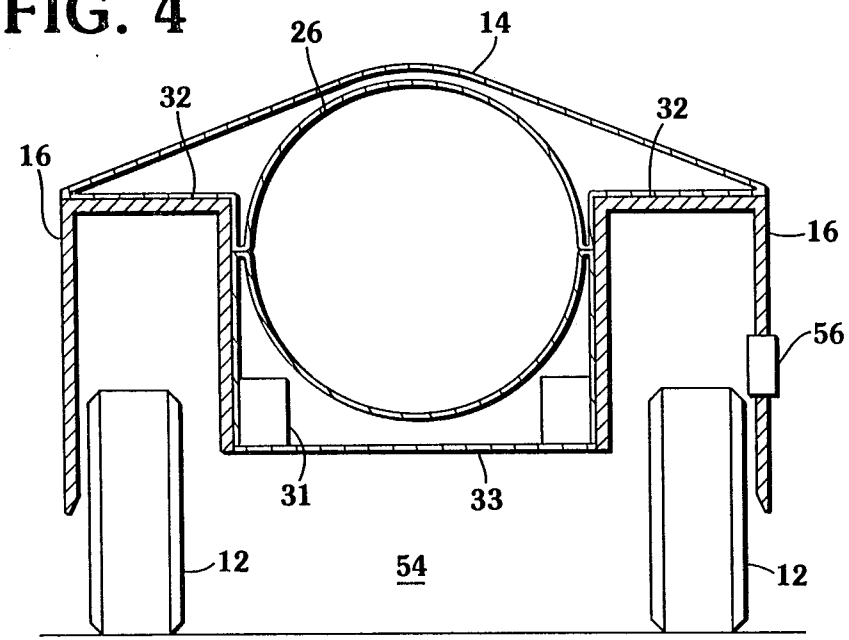
FIG. 4 is a schematic section view taken on line 4—4 in FIG. 3 with wheels in the vehicle movement position.
Figure 5:
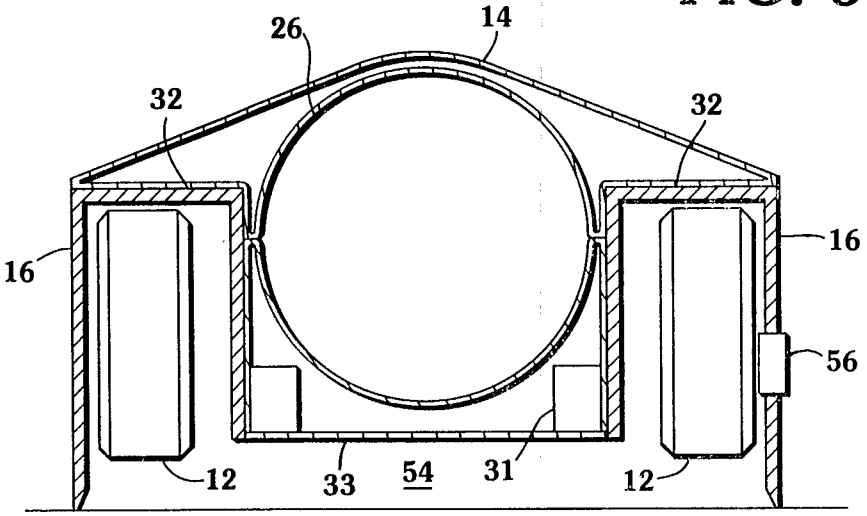
FIG. 5 is a schematic section view taken on line 4—4 in FIG. 3 with wheels in the retracted position.

Details of the internal structure of vehicle 10 with missile in place are schematically illustrated in FIG. 3. Vehicle 10 has a generally rectangular low profile. Preferably, the width should not be beyond 10 or 12 feet so that the vehicle is as "road legal" as possible. For optimum resistance to blast winds, a width-to-height ratio of at least about 2:1 is preferred. Missile 24 within canister 26 is contained between elongated housings 32 which surround wheels 12 and provide space and support for drive engines 34. The top of housings 32 (the cross-sections of which are best seen in FIGS. 4 and 5) and shell 14 are cutaway in FIG. 3 to show the internal components. The extra space within housing 32 between the sets of wheels can contain any control, communications or other equipment desired.

As is discussed in greater detail below, means may be provided to actively pump air from the chamber beneath vehicle 10 to help hold the vehicle to the ground by a "reverse ground effect". Typical of such means would be a conventional engine exhaust driven turboblower 35, as schematically indicated in FIG. 3, to pump from the chamber.

The elevated, mobile, position of vehicle 10 and the retracted, protective, position are shown schematically in vehicle cross-section in FIGS. 4 and 5, respectively. Wheel axles, drive means, etc., are omitted for clarity. In the elevated position, wheels 12 extend well below skirts 16 to provide excellent ground clearance for travel over rough ground. Missile canister 26 is well protected between housings 32 above floor 33 and can be mounted using any conventional shock and vibration protection. In the retracted position of FIG. 5, wheels 12 are retracted well up into housings 32, with the entire vehicle weight resting on the lower edges of skirt 16. Boxes 31 schematically illustrate structural box beams which could also function as desired as conainers for missile or vehicle control means.

On a hard, level surface such as asphalt or hard dirt, simple skirt edges as seen in FIG. 5 may be sufficient to "dig-in" to the surface and resist air leakage or skiding. Other skirt seal embodiments are shown in FIGS. 6, 7, and 8 which may be preferred under some circumstances.

Figure 6:
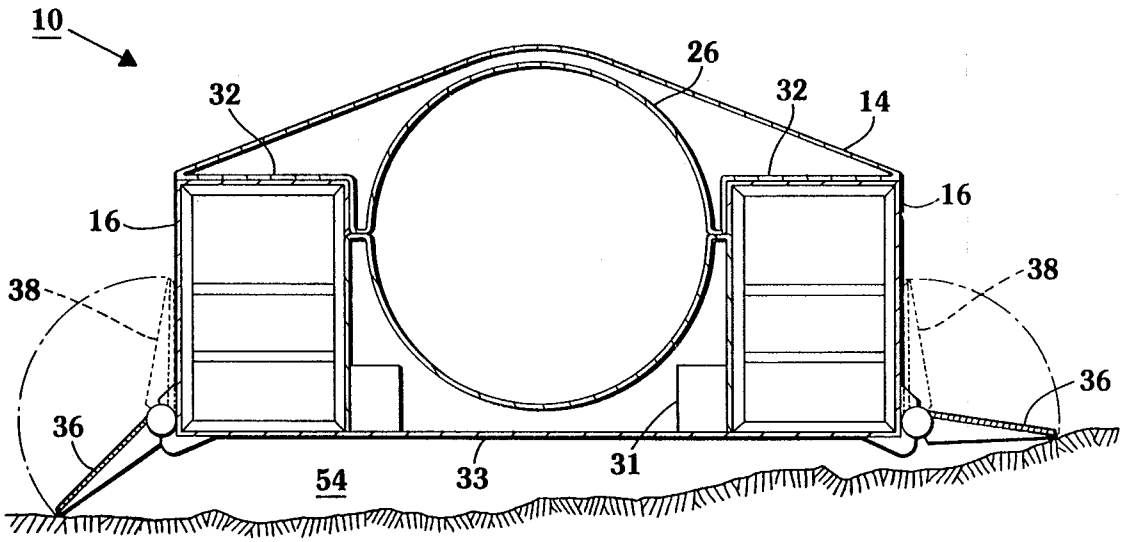
FIGS. 6, 7 and 8 are schematic section views taken on line 6—6 in FIG. 3 through a vehicle illustrating three ground seal embodiments.
Figure 7:
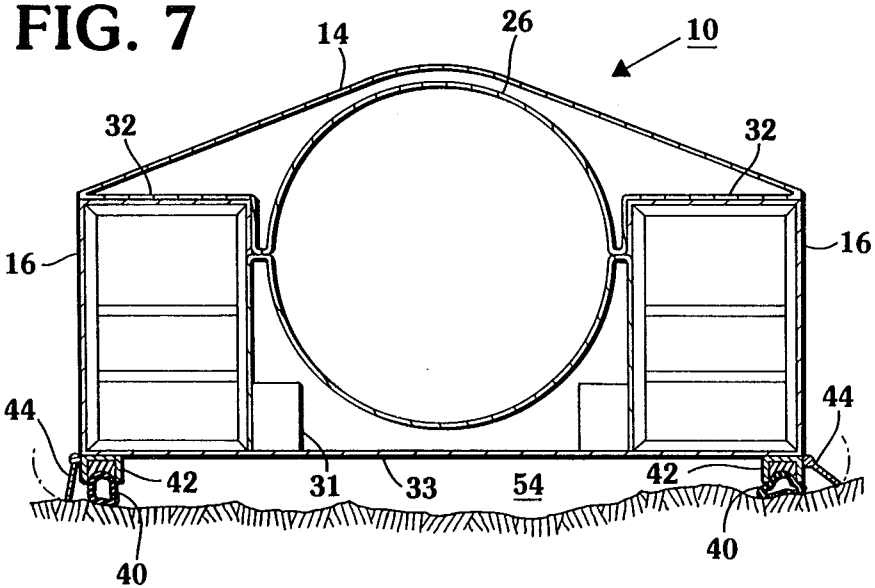

In the embodiment of FIG. 6, hinged flat panel struts 36 are moved from the broken line position 38 to the position shown in contact with the earth's surface. These struts 36 accommodate irregular ground surfaces and are effective in preventing blast air leakage under vehicle 10, since overpressure will tend to force the lower strut edge tighter against the ground. Flexible panels connect adjacent panels along each side of vehicle 10 and at the corners. The hinge for struts 36 includes a conventional, strong one-way ratchet means (not shown) so that they can be easily swung out and down into ground contact, but cannot be returned to the retracted position without manual or remotely-controlled release of the ratchet. Thus, in this embodiment vehicle 10 is fully supported by struts 36 which act as extensions of skirt 16, Improved sealing is accomplished by the embodiment shown in FIG. 7. Here, an inflated tube 40 is mounted on support 42 along the edge of skirt 16. Tube 40 precisely accommodates minor irregulatories in the ground surface. Protection of the tube 40 against thermal radiation and direct blast impingement is provided by struts 44, generally similar to strut 36 shown in FIG. 6. In this case, however, struts 44 do not help support the vehicle; rather, they function only as thermal radiation shields. While this embodiment does somewhat improve sealing along the edge of skirt 16, it does so at a slight increase in complexity.

Figure 8:
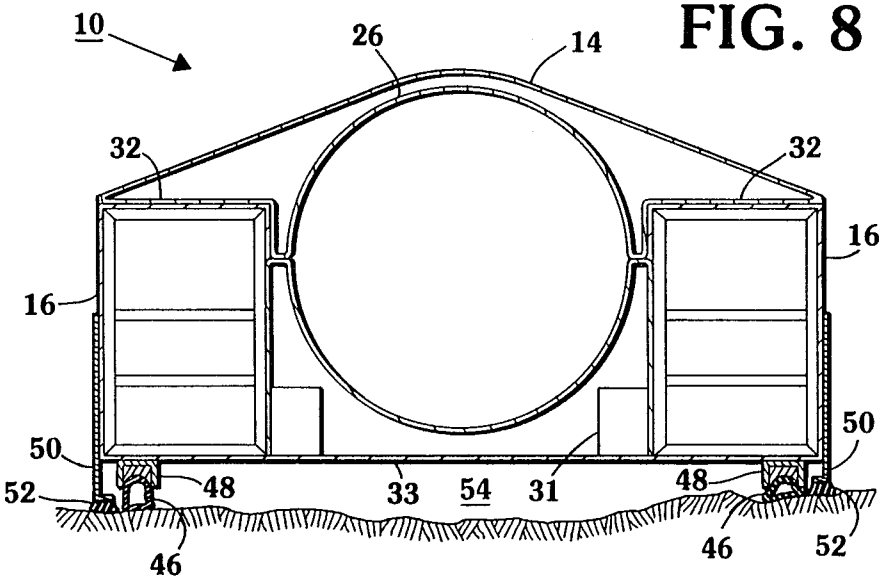

Another sealing means embodiment is schematically illustrated in FIG. 8. Here, an inflated tube 46 and support means are provided, generally identical to tube 40 and support 42 shown in FIG. 7. Tube 40 in this case is protected against direct effects of thermal radiation and blast wind by a sliding panel 50 which drops down, bringing a soft, spongy lower portion 52 into ground contact.

The volume of the chamber 54 below floor 33 and within the wheel wells formed by housing 32 should be as large as possible and should be maintained at as low a pressure as is possible. Large chamber volumes (combined with good seals) will maximize the pressure difference tending to hold the vehicle to the ground and will also maximize the length of time this condition will persist. During passage of the actual blast overpressure wave, the outside pressure will be very high. However, any increase in the pressure differential will help hold the vehicle in place, especially during passage of the rarefaction wave over the vehicle.

Plenum volume overpressure valves 56 (of which one is schematically shown in FIG. 5) are preferably included to relieve pressure in the chamber if it exceeds the lowest pressure outside the vehicle. This excess pressure may be caused by seal leakage, outside pressure below normal atmospheric due to the blast rarefaction wave or a combination thereof. Relief valves may be placed at any suitable locations on shell 14 or skirts 16 so that 54 is automatically vented to the lowest pressure face of the vehicle. Any suitable conventional check-type valves may be used, such as poppet or flapper valve. Or more positive control valves controlled by pressure sensors on the outer vehicle skin could be used, if desired.

Active pumping of air from the chamber either into the interior of the vehicle above the chamber or to the outside atmosphere can increase blast hardness by increasing the pressure differential between the chamber and the outside air which increases the downward force and the resulting horizontal friction force resisting blow-away. Also, such pumping reduces the level of seal excellence required by allowing a higher level of seal leakage for a given pressure differential. Any conventional gas pumping techniques can be used to move air from the chamber to either the upper interior of the vehicle or to the outside atmosphere. Such methods include ducting of the vehicle engine intakes to the chamber, use of engine exhaust driven turbo-blowers (superchargers) to pump the chamber, use of solid propellant cartridge gas generator driven blowers (similar to turbojet engine starters) to pump air from the chamber, or pumping the chamber with solid propellant rocket/ejectors or blowers mechanically driven by the vehicle engines.

Figure 9:
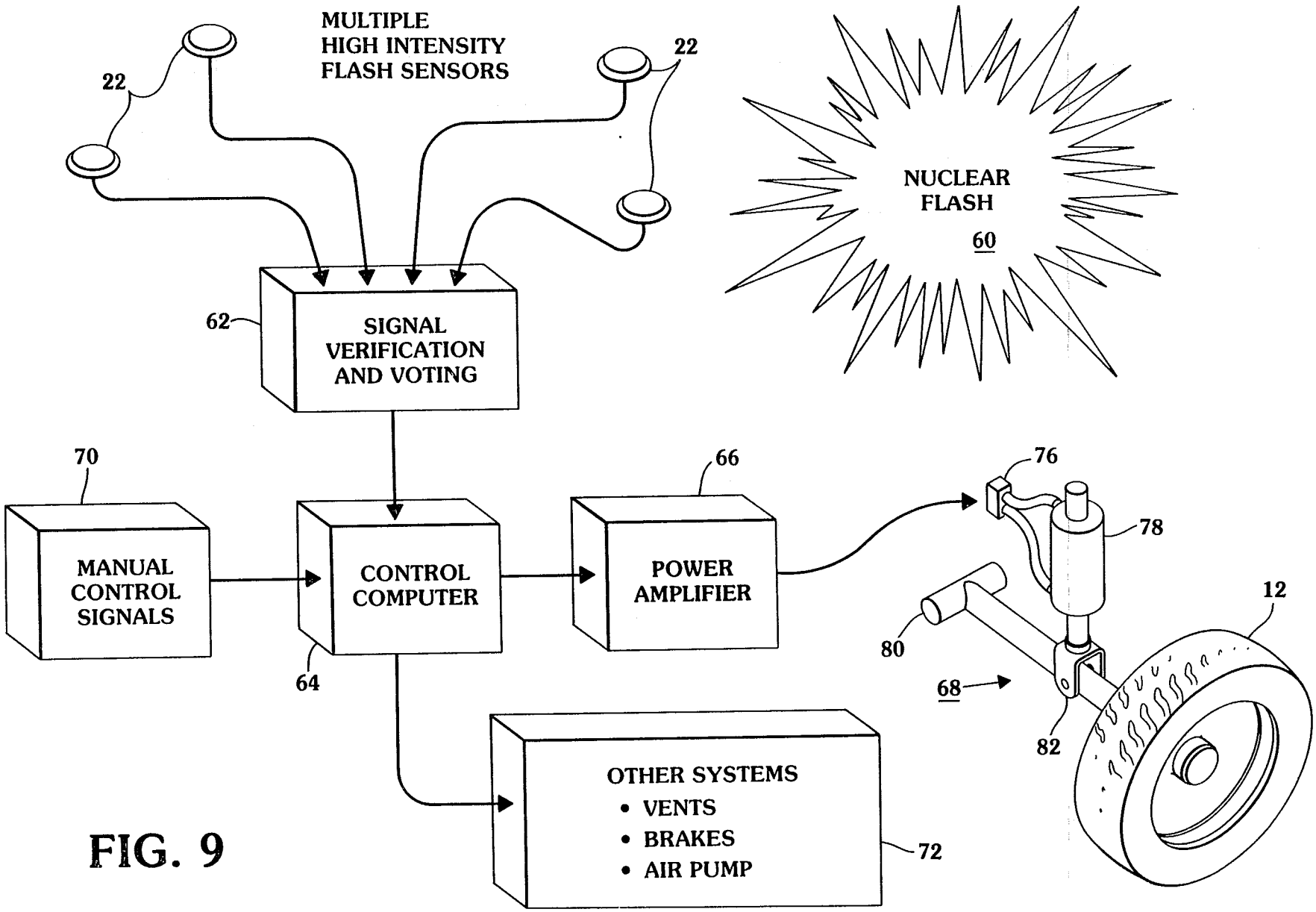
FIG. 9 is a schematic diagram illustrating operation of the sensor and wheels retraction system.

The coordinated operation of the various systems in the event of a nearby nuclear detonation is schematically illustrated in FIG. 9.

The flash of nearby nuclear detonation 60 is picked up by several of the flash sensors 22 spaced across shell 14 (as seen in FIG. 1). The signals pass to conventional comparison circuitry 62 which verifies the signals and "votes" to assure that a single sensor has not merely sent a spurious signal. The signal reporting the confirmed flash passes to a conventional central control computer 64 which activates a power amplifier 66 to raise wheels 12 by means of a hydraulic system 68. Alternatively, a warning that an attack is imminent may be received by vehicle personnel, who can then start the protective sequence by a manual input to computer 64. In the sequence programmed into computer 64, actuaters 72 are operated to close vents, set the brakes, turn on the chamber air pump and perform any other operation desired. For use and drills, tests or the like, signals may be sent to the computer through a manual control 70 such as keyboard, push-button or the like. The schematically illustrated hydraulic system 68 typically includes a reversible control valve 76 causing hydraulic cylinder 78 to raise or lower wheel axle system 80 through clevis 82 about an axis at the inner end of axle 80. If the wheel is powered, a suitable drive axle (not shown) would extend through the lifting axle 80. Of course, any suitable means other than the illustrated hydraulic system could be used to raise wheels 12, such as electrical drives, pyrotechnic latch releases, etc.

With the system as shown in FIG. 9, the vehicle can go from movement along a road to a stopped, fully retracted, vent closed and chamber pumping state in very few seconds. If the nuclear explosion is too close to permit reaching the protected state before arrival of the blast wave, the intensity of heat and blast at that distance would not be survivable in any event. However, with the warning times currently envisioned for surprise attacks and the mobility, blast hardness and nuclear hardness provided by this vehicle, most would survive.

While certain specific devices and arrangements were detailed in conjunction with the above description of preferred embodiments of this invention, these may be varied, where suitable, with similar results.

Other applications, variations and ramifications of this invention will become apparent to those skilled in the art upon reading this disclosure. These are intended to be included within the scope of this invention as defined in the appended claims.

We claim:

1. A nuclear blast hardened mobile vehicle comprising;

a chassis having a blast-resistant shell thereover;

a plurality of earth-engaging motive members on said chassis adapted to move said vehicle over the earth's surface;

drive means for causing said motive members to move said vehicle;

retraction means to retract said motive members;

skirt means extending downwardly around said shell, adapted to ride above the earth during vehicle movement and contact the earth when said motive members are retracted to substantially seal the air volume within said shell from the outside air; and means for actively pumping air out of the chamber formed by said skirt in ground contact, the ground under the vehicle and the underside of said vehicle.

2. The vehicle according to claim 1 further including a plurality of overpressure relief valves adapted to release pressure under the vehicle in the retracted motive means state to the atmosphere whenever the pressure under the vehicle exceeds that outside the vehicle.

3. The method of protecting a mobile vehicle against nuclear blast which comprises the steps of:

providing a blast resistant shell over said vehicle with a downwardly extending skirt having a lower edge a substantially uniform distance above the ground when vehicle motive members are in a ground-engaging mobile position;

sensing the flash of a nearby nuclear detonation;

stopping movement of said vehicle;

closing all vents in said shell and shirt;

retracting said motive members sufficiently so that said vehicle rests on the lower edge of said skirt; and actively pumping air from the chamber formed by the underside of the vehicle and the skirts when the vehicle is in the retracted state.

4. The method according to claim 3 further including the step of actively pumping air from the chamber formed by the underside of the vehicle and the skirts when the vehicle is in the retracted state.

5. A nuclear blast hardened mobile vehicle comprising:

a chassis having a blast-resistant shell thereover;

a plurality of earth-engaging motive members on said chassis adapted to move said vehicle over the earth's surface;

drive mean for causing said motive members to move said vehicle;

retraction means to retract said motive members; and skirt means extending downwardly around said shell, adapted to ride above the earth during vehicle movement and contact the earth when said motive members are retracted to substantially seal the air volume within said shell from the outside air;

said skirt means including seal means between the lower edge of said skirt and the earth's surface to accommodate an irregular surface; and said seal means comprising an inflatable tube running along the lower edge of said skirt and at least one heat shield flap hinged adjacent and parallel to the lower edge of said skirt, adapted to swing out and down into ground contact outside said tube, whereby said tube is substantially protected from direct exposure to heat radiation from an external source.

6. The vehicle according to claim 5 wherein said seal means further includes at least one vertically slidable panel mounted on the exterior surface of said skirt and adapted to slide downwardly outside said tube to substantially protect said tube from heat radiation from an external source.

7. A nuclear blast hardened mobile vehicle comprising:

a chassis having a blast-resistant shell thereover;

a plurality of earth-engaging motive members on said chassis adapted to move said vehicle over the earth's surface;

drive mean for causing said motive members to move said vehicle;

sensor means on said shell to detect the flash produced by a nuclear blast in the vicinity of the vehicle;

retraction means activated by said sensors to retract said motive members when the flash of a nuclear blast is detected; and skirt means extending downwardly around said shell, adapted to ride above the earth during vehicle movement and contact the earth when said motive members are retracted to substantially seal the air volume within said shell from the outside air, said skirt means includes seal means between the lower edge of said skirt and the earth's surface to accommodate an irregular surface; and said seal means comprising a plurality of segmented strut panels hinged to said skirt along with a line substantially parallel to the lower edge of said skirt with flexible panels between adjacent strut panels, the hinges each including a one-way ratchet means permitting said strut panels to be rotated away from said skirt and downwardly into contact with the earth but not permitting reverse rotation without disengagement of said ratchet means whereby said strut panels can be brought into earth contact prior to retraction of said motive members, with said strut panels supporting said vehicle upon said rotation.

8. In a nuclear blast hardened mobile vehicle which includes a protective shell, motive means to move the vehicle over the earth's surface, means to protect vehicle contents against a nearby nuclear blast, retraction means adapted to retract said motive means, and skirt means extending downwardly from said shell around said vehicle having a lower edge adapted to ride above the earth during vehicle movement and substantially uniformly contact the earth when said motive means is retracted to substantially seal the air volume within said shell from the outside atmosphere;

the improvement comprising:

means for actively pumping air out of the chamber formed by said skirt in ground contact, the ground under the vehicle and the underside of said vehicle.

9. The improvement according to claim 8 further including a plurality of overpressure relief valves adapted to release pressure under the vehicle in the retracted motive means state to the atmosphere whenever the pressure under the vehicle exceeds that outside the vehicle.

10. In a nuclear blast hardened mobile vehicle which includes a protective shell, motive means to move the vehicle over the earth's surface, means to protect vehicle contents against a nearby nuclear blast, retraction means adapted to retract said motive means, and skirt means extending downwardly from said shell around said vehicle having a lower edge adapted to ride above the earth during vehicle movement and substantially uniformly contact the earth when said motive means is retracted to substantially seal the air volume within said shell from the outside atmosphere;

the improvement comprising:

seal means between the lower edge of said skirt and the earth's surface comprising an inflatable tube running along the lower edge of said skirt and at least one heat shield flap hinged adjacent and parallel to the lower edge of said skirt, adapted to swing out and down into ground contact outside said tube, whereby said tube is substantially protected from direct exposure to external heat.

11. The improvement according to claim 10 wherein said seal means further includes at least one vertically slidable panel mounted on the exterior surface of said skirt and adapted to slide downwardly outside said tube to substantially protect said tube from external heat.

* * * * *